United States Patent [19]

Brimmeier

[11] 4,238,086

[45] Dec. 9, 1980

[54] KITE STRING WRAPPER

[76] Inventor: Albert L. Brimmeier, 102 Maplewood Dr., Pittsburgh, Pa. 15214

[21] Appl. No.: 77,395

[22] Filed: Sep. 20, 1979

[51] Int. Cl.[3] ..... B65H 75/38; B65H 75/44

[52] U.S. Cl. ..... 242/96; 242/99; 242/100; 242/104; 242/110

[58] Field of Search ..... 242/96, 99, 100, 110.3, 242/104, 106, 85, 110, 115

[56] References Cited

U.S. PATENT DOCUMENTS

| | | | |
|---|---|---|---|
| 1,567,483 | 12/1925 | Bear | 242/99 |
| 2,007,699 | 7/1935 | Wiebking | 242/99 |
| 2,585,263 | 2/1952 | Miller | 242/100 |
| 3,815,842 | 6/1974 | Scrogin | 242/96 |
| 3,952,965 | 4/1976 | Falcon | 242/99 |
| 4,106,719 | 8/1978 | Haverland | 242/96 |

*Primary Examiner*—Stanley N. Gilreath

[57] ABSTRACT

A kite string reel device, including a reel or spool rotated manually by means of a crank handle, the reel being supported inside a box-like frame or housing, and the reel, in one design, being adjustable for handling different lengths of string, by having an adjustable sized hub.

1 Claim, 5 Drawing Figures

Fig. 1
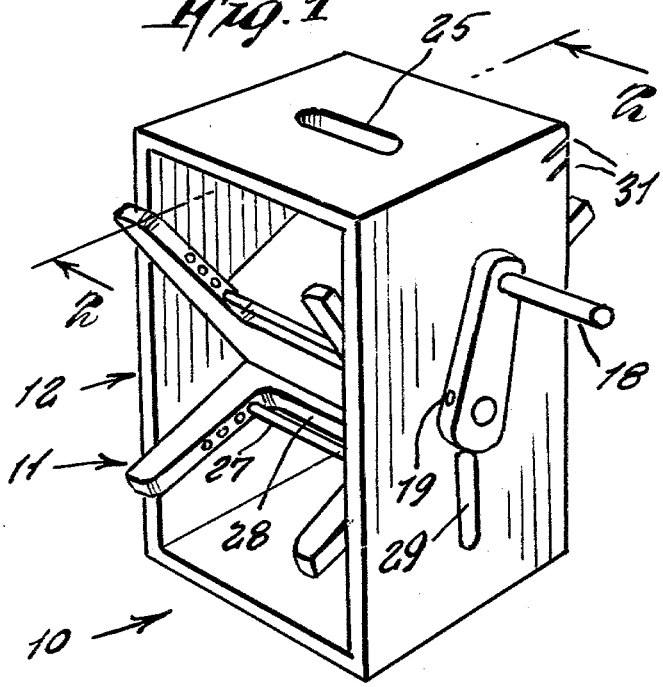
Fig. 4
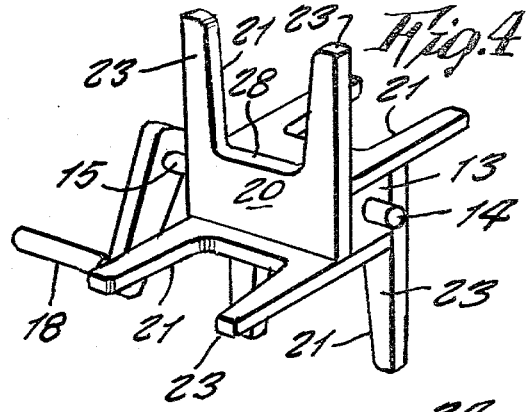
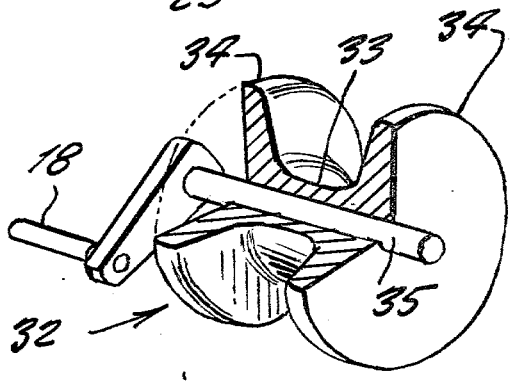
Fig. 5
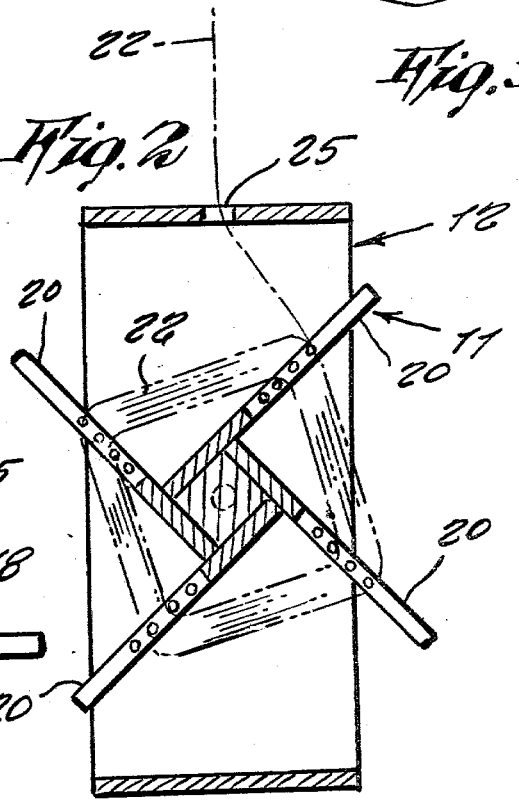
Fig. 3
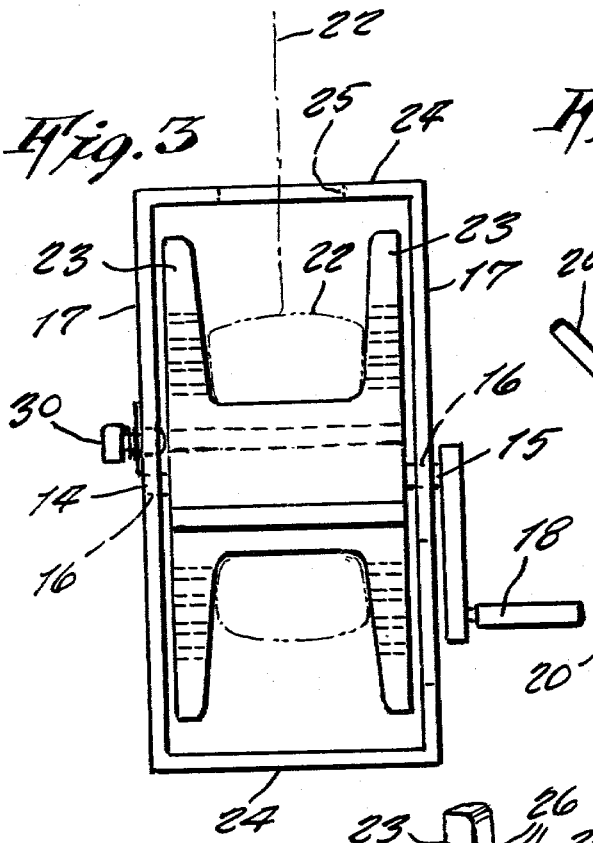
Fig. 1a
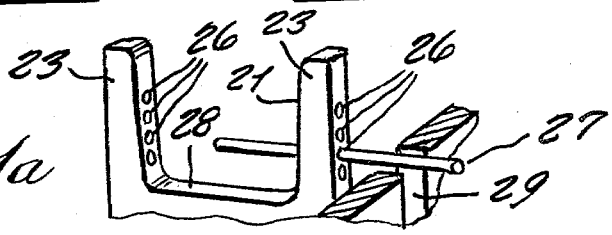

KITE STRING WRAPPER

This invention relates generally to kite string reels.

It is well known, that sometimes it is wished to fly a kite at a great height, so that several kite strings are tied together, which is tiring to reel, and uncomfortable to hold when most is reeled in.

Accordingly, it is a principal object of the present invention to provide a kite string wrapper, that holds up to three or four balls of kite string, and which is quick and easy to reel in, and comfortable to support.

Another object is to provide a kite string wrapper, which would make an ideal souvenir for beach resorts, where kites are frequently flown, and which could be rented out, with an option to buy as a souvenir; labels from the particular beach being printed or pasted thereupon.

Another object is to provide a kite string wrapper, which can alternately be used, also, by surveyors, to hold measuring tape, or used by fishermen, to hold fishing line.

Still another object is to provide a kite string wrapper, that prevents a tangle, or knots, being formed along a line, when being reeled in or out.

Still a further object is to provide a kite string wrapper, which alternately may be made to include a transmission for a faster reeling in or out of a line.

Still another further object is to provide a kite string wrapper, in which a reel hub is adjustable in size, so as to accommodate faster reeling of shorter lines.

Other objects are to provide a kite string wrapper, which is simple in design, inexpensive to manufacture, rugged in construction, easy to use, and efficient in operation.

These, and other objects, will be readily evident, upon a study of the following specification, and the accompanying drawing, wherein:

FIG. 1 is a perspective view of the invention, and shown including adjustable rods, about which the cord can be wound, so that, if a cord is shorter, it can be wound around a larger circle, and thus require l ess rotation of the handle during a wind-up, whereas, if the cord is longer, it must be wound up around a smaller circle, so that the reel holds all of it;

FIG. 1*a* illustrates how the rods of FIG. 1 are adjustable;

FIG. 2 is a cross-sectional view, on line 2—2 of FIG. 1;

FIG. 3 is a side view thereof;

FIG. 4 is a perspective view of the reel of FIG. 1, shown modified by not including the adjustable rod feature, and FIG. 5 is a perspective view of a plastic roller for use in a kite string wrapper, instead of the foregoing flat bladed designs.

Referring now to the draing in greater detail, and more particularly, to FIGS. 1 through 4 thereof at this time, the reference numeral 10 represents a kite string wrapper, according to the present invention, wherein there is a reel 11, rotatably supported in a box-like frame 12.

The reel is made of wood, and includes a cross-sectionally square spool 13, which, at opposite ends 14 and 15, is turned round, so as to rotate within cylindrical bearing holes 16, provided on opposite side walls 17 of the frame. One end 15 is long, so as to protrude outward of the bearing hole, and a crank, of a crank handle 18, is secured therein by a cross pin or nail 19. Four flat blades 20 are each affixed to one side of the spool, as best shown in FIGS. 2 and 4, each blade having an outward extending end, having a notch 21 on its end edge, so that the four notches, together, thus form an annular groove of the reel, in which a string, or line, 22 can be reeled. The outward extending opposite legs 23, of each blade, thus, together with the legs 23 of the other blades, form a pair of flanges on each side of the annular groove, so as to hold the reeled string in the groove.

The frame includes, also, opposite end walls 24, one of which has a slot 25, through which the string is paid out from the reel, as shown in FIGS. 2 and 3.

In the present design, a row of aligned, transverse holes 26, along each of the legs, may selectively receive cross pins 27, so that, as shown in FIG. 2, a shorter length of string can be rolled around the four cross pins, instead of around the bottom edge 28 of the notches, so that, in effect, the cross pins, together, form a larger size of hub, so as to allow a quicker reeling in of a shorter string, that does not require a full depth of annular groove for being entirely fitted on the reel.

A slot 29, on one side wall of the frame, is shown on the drawing extending in a radial direction respective to the rotational axis of the reel, and allows easy removal, relocation and re-insertion of the cross pins 27 in selected ones of the holes 26.

A push button spring brake 30, on one side wall 17, serves to slow down a reel rotation while a line is running out.

Two saw cuts 31, shown on the drawing extending parallel to each other, and angularly inclined respective to an edge of the box-like frame, serve to lock the string therein, for prevention of further unreeling, when the outer end of the string is pulled, such as by a kite.

While the above described reel is made all of wood, it may be substituted by a molded plastic reel 32, shown in FIG. 4, and which includes a circular annular groove 33 between circular flanges 34. A crank shaft 35 is fractionally fitted in a central hole 36 thereof.

While the invention may be made in any size, the following suggests a practical size. The frame is four and one-half by five by ten inches. Each blade is three inches long, and three and one-half inches wide, while the spool is two inches wide on each side, the spool over-all length, together with its turned ends, measuring five and three-fourth inches.

While various changes may be made in the detail construction, it is understood that such changes will be within the spirit and scope of the present invention, as is defined by the appended claims.

What I now claim is:

1. A kite string wrapper, comprising, in combination, a box-like frame, a reel rotatably supported in said frame, a crank handle attached to said reel, and a length of string wound on said reel, said string being paid out of a slot on one wall of said frame; said reel comprising a plurality of radially extending, flat blades affixed to a central spool, each said blade having an end-edge notch forming a pair of opposite side legs, a row of aligned holes in each said pair of legs, a cross pin selectively inserted through said aligned holes, a radially extending second slot on another wall of said frame, aligning with all said row of holes for insertion of said cross pins, a pair of saw cuts on said frame for locking said string therein, and a spring brake on said frame for braking a rotation of said reel.

* * * * *